US012343652B2

(12) United States Patent
Yamada et al.

(10) Patent No.: US 12,343,652 B2
(45) Date of Patent: Jul. 1, 2025

(54) TRANSFORMABLE TOY

(71) Applicant: Spin Master Ltd., Toronto (CA)

(72) Inventors: Satoshi Yamada, Chiba (JP); Fujio Nobata, Tokyo (JP)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 17/220,408

(22) Filed: Apr. 1, 2021

(65) Prior Publication Data

US 2021/0220751 A1 Jul. 22, 2021

Related U.S. Application Data

(60) Continuation of application No. 15/917,035, filed on Mar. 9, 2018, now Pat. No. 10,987,604, which is a (Continued)

(30) Foreign Application Priority Data

Feb. 20, 2006 (JP) ..... 2006-41918

(51) Int. Cl.
*A63H 33/26* (2006.01)
*A63H 3/00* (2006.01)
*A63H 33/00* (2006.01)

(52) U.S. Cl.
CPC ..... *A63H 33/003* (2013.01); *A63H 3/003* (2013.01); *A63H 33/26* (2013.01)

(58) Field of Classification Search
CPC ..... A63H 33/003; A63H 33/26; A63H 33/00; A63H 33/005; A63H 17/008; A63H 17/02; A63H 3/003; A63H 3/04; A63H 3/36
(Continued)

(56) References Cited

U.S. PATENT DOCUMENTS 152,250 A * 6/1874 Powers ..... A63H 13/16 446/361
1,557,751 A * 10/1925 Winks ..... A63B 43/00 473/577
(Continued)

FOREIGN PATENT DOCUMENTS

CA 1328474 4/1994
CA 2454000 10/2001
(Continued)

OTHER PUBLICATIONS

*Mattel, Inc.* v. *Spin Master Ltd.*, Inter Partes Review IPR2018-01674 of U.S. Pat. No. 9,975,058, filed Sep. 7, 2018.
(Continued)

*Primary Examiner* — John E Simms, Jr.
(74) *Attorney, Agent, or Firm* — Aird & McBurney LP

(57) ABSTRACT

A toy with an exterior structure. Constructed to transform from a rollable first shape to a second shape. An interior structure inside the exterior structure is endowed with a magnetic body that moves by way of a magnetic force that acts from the exterior of the toy, an interior locking portion that moves simultaneously with the movement of this magnetic body, and a biasing member that effects a force which moves or turns this interior locking portion in a particular direction. If the magnetic force does not act from the exterior of the toy, the first shape of the exterior structure maintained. In the event that a magnetic force has acted from the exterior of the said toy, the exterior structure transforms from the first shape to the second shape.

20 Claims, 12 Drawing Sheets

Related U.S. Application Data continuation of application No. 15/343,872, filed on Nov. 4, 2016, now Pat. No. 9,975,058, which is a continuation of application No. 15/091,283, filed on Apr. 5, 2016, now Pat. No. 9,868,073, which is a continuation of application No. 13/939,033, filed on Jul. 10, 2013, now Pat. No. 9,308,461, which is a division of application No. 12/821,890, filed on Jun. 23, 2010, now Pat. No. 8,500,508, which is a continuation of application No. 11/644,913, filed on Dec. 22, 2006, now Pat. No. 7,785,168.

(58) Field of Classification Search
USPC ..... 472/54; 446/71, 72, 73, 129, 130, 139, 446/308, 309, 310, 311, 487
See application file for complete search history.

(56) References Cited

U.S. PATENT DOCUMENTS 2,809,062 A 10/1957 Mainhardt
3,166,322 A 1/1965 Branneman
3,411,237 A 11/1968 Crosman
3,520,078 A 7/1970 Klamer
3,626,961 A 12/1971 Quinones
3,687,452 A * 8/1972 Thompson ..... A63B 43/00 473/577
4,326,235 A * 4/1982 Hopkins ..... E05B 47/00 292/201
4,411,097 A 10/1983 Murakami
4,516,948 A 5/1985 Obara
4,571,199 A 2/1986 Murakami
4,575,348 A * 3/1986 Wiggs ..... A63H 13/16 446/330
4,581,904 A 4/1986 Lehmann et al.
4,605,383 A 8/1986 Horiuchi
4,606,618 A 8/1986 Geller
D287,258 S 12/1986 Maruyama
4,674,990 A 6/1987 Ohno
4,687,459 A 8/1987 Lockett
4,696,656 A 9/1987 Torres et al.
4,698,043 A * 10/1987 May ..... A63H 33/005 446/273
4,708,687 A * 11/1987 Goldberg ..... A63H 3/46 446/376
4,817,936 A * 4/1989 Matsuda ..... A63H 33/005 446/355
4,874,340 A 10/1989 Smallwood
4,891,995 A 1/1990 Lin
5,019,010 A 5/1991 Nikaido et al.
5,076,623 A 12/1991 Richards
5,090,935 A 2/1992 Monson
5,090,938 A 2/1992 Reynolds
5,098,327 A 3/1992 Ferrero
5,169,156 A * 12/1992 Smollar ..... A63H 17/02 463/52
5,188,405 A 2/1993 Maccaferri
5,209,345 A 5/1993 Haugabook
5,310,378 A * 5/1994 Shannon ..... A63H 33/004 446/72
5,439,408 A * 8/1995 Wilkinson ..... A63H 33/005 446/458
5,672,129 A * 9/1997 Fisher ..... A63B 59/70 473/573
5,701,702 A * 12/1997 Reid ..... E05B 47/0038 160/180
5,760,689 A * 6/1998 Holmgren ..... A47F 3/002 70/57.1
5,855,499 A 1/1999 Yamazaki et al.
5,893,791 A * 4/1999 Wilkinson ..... A63H 33/005 446/471
5,916,007 A * 6/1999 Maxim ..... A63H 29/04 446/130
6,126,507 A 10/2000 Lieberman
6,203,393 B1 3/2001 Flynn
6,225,885 B1 5/2001 Lin
6,231,346 B1 * 5/2001 Sagi-Dolev ..... G09B 23/00 446/73
6,261,146 B1 7/2001 Spector
6,261,149 B1 7/2001 Moore
6,572,436 B1 6/2003 So
6,592,427 B1 * 7/2003 Wilhelm ..... A63H 33/3044 105/1.5
6,638,136 B1 10/2003 Lee et al.
6,719,606 B1 4/2004 Mukensturm
6,752,679 B1 6/2004 Lui
7,297,042 B2 11/2007 Whitehead
7,306,504 B2 12/2007 Saucier
7,458,874 B2 2/2008 Rung et al.
8,777,689 B1 * 7/2014 Neal ..... A63H 17/02 446/6
9,120,025 B2 9/2015 Hudson et al.
9,526,998 B2 12/2016 Hudson et al.
9,757,659 B2 * 9/2017 Hashemi ..... A63H 3/52
11,376,515 B1 * 7/2022 Livingston ..... A63H 3/36
2002/0077024 A1 * 6/2002 Choi ..... A63H 11/00 446/357
2002/0098770 A1 * 7/2002 Mesch ..... A63H 13/16 446/310
2002/0098773 A1 7/2002 Hornsby et al.
2003/0016443 A1 1/2003 Shin
2003/0176147 A1 9/2003 Norman
2005/0112988 A1 5/2005 Whitehead
2006/0009115 A1 * 1/2006 Saucier ..... A63H 3/003 446/268
2007/0197124 A1 * 8/2007 Sato ..... A63H 11/00 446/129
2010/0291831 A1 * 11/2010 Yamada ..... A63H 33/003 446/129
2012/0329365 A1 * 12/2012 Johnston ..... A63H 33/26 446/470
2016/0157461 A1 * 6/2016 Hill ..... A01K 5/0114 119/51.01
2016/0325191 A1 11/2016 Cai
2017/0028305 A1 2/2017 Cai
2017/0189821 A1 7/2017 Cai

FOREIGN PATENT DOCUMENTS

CA 2857579 6/2013
CA 2868116 1/2015
CA 2878517 1/2015
CA 2900133 5/2015
CA 2889882 7/2015
CA 2913660 4/2016
CA 2950224 4/2016
CA 2923104 7/2016
CA 2944628 12/2016
CA 2899674 4/2017
CA 2906265 6/2017
CA 2906247 7/2017
CA 2917006 7/2017
CA 2906252 9/2017
EP 0337960 10/1989
FR 2559072 8/1985
GB 2123795 2/1984
GB 2184663 7/1987
GB 2217218 10/1989
JP 57-126289 1/1956
JP 38-9155 5/1963
JP S38-009115 * 5/1963
JP 58-126893 8/1983
JP 58-165881 9/1983
JP 58-179191 11/1983
JP 59-91984 5/1984
JP 3001886 9/1984
JP 60-128693 8/1985
JP 62-111092 7/1987
JP S62-111092 * 7/1987 ..... A63H 33/003
JP 63-122488 8/1988
JP 1-112893 7/1989
JP 61-115593 7/1990

(56) References Cited

FOREIGN PATENT DOCUMENTS

| | | |
|---|---|---|
| JP | 2003-062359 | 3/2003 |
| JP | 2003-190648 | 7/2003 |
| JP | 2003-225457 | 8/2003 |
| JP | 3112866 | 8/2005 |
| WO | 0156674 | 8/2001 |
| WO | 2006051417 | 5/2006 |

OTHER PUBLICATIONS

*Mattel, Inc.* v. *Spin Master Ltd.*, Inter Partes Review IPR2018-01672 of U.S. Pat. No. 8,500,508, filed Sep. 7, 2018.

*Mattel, Inc.* v. *Spin Master Ltd.*, Inter Partes Review IPR2018-01673 of U.S. Pat. No. 9,868,073, filed Sep. 7, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Thomas and Friends Grain Loader and U.S. Pat. No. 6,592,427, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using JP H05-00160 and Mattel Barbie Travelin House, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using U.S. Pat. No. 5,310,378 and Princess Magic Touch Candy Pendant, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Bandai Tackleboy, Thomas and Friends Grain Loader, and U.S. Pat. No. 6,592,427, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Bandai Tackleboy and Thomas and Friends Grain Loader, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Bandai Tackleboy and Princess Magic Touch Candy Pendant, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using JP Utility Model Application 38-9155, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Transformers Cybertron Override and Princess Magic Touch Candy—Pendant, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,975,058 using Transformers Universe Swerve with Roadhandler and Princess Magic Touch Candy—Pendant, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Thomas and Friends Grain Loader and U.S. Pat. No. 6,592,427, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using JP H05-00160 and Mattel Barbie Travelin House, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using U.S. Pat. No. 5,310,378 and Princess Magic Touch Candy Pendant, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Bandai Tackleboy, Thomas and Friends Grain Loader, and U.S. Pat. No. 6,592,427, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Bandai Tackleboy and Thomas and Friends Grain Loader, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Bandai Tackleboy and Princess Magic Touch Candy Pendant, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using JP Utility Model Application 38-9155, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Transformers Cybertron Override and Princess Magic Touch Candy—Pendant, served via Email Sep. 24, 2018.

*Spin Master Ltd.* v. *Alpha Group US LLC*, Case No. 18-cv-1046-RGK, pending in the United States District Court, Central District of California, Western Division, Defendant Alpha Group's Invalidity Contentions for U.S. Pat. No. 9,868,073 using Transformers Universe Swerve with Roadhandler and Princess Magic Touch Candy—Pendant, served via Email Sep. 24, 2018.

*Spin Master Limited.* v. *Mattel Pty Ltd*, Case No. VID1167/2017, pending in Federal Court of Australia, Affidavit of Ian James Anderson filed Oct. 1, 2018.

*Spin Master Limited.* v. *Mattel Pty Ltd*, Case No. VID1167/2017, pending in Federal Court of Australia, First Affidavit of Nadia Maree Odorico filed Oct. 1, 2018.

*Spin Master Limited.* v. *Mattel Pty Ltd*, Case No. VID1167/2017, pending in Federal Court of Australia, Affidavit of Isobel Sarah Taylor filed Oct. 1, 2018.

*Spin Master Limited.* v. *Mattel Pty Ltd*, Case No. VID1167/2017, pending in Federal Court of Australia, Second Affidavit of Nadia Maree Odorico filed Oct. 1, 2018.

*Choirock Contents Factory Co., Ltd.* v. *Spin Master Ltd., et al.*, IPR No. IPR2017-00030, filed Oct. 7, 2016, Final Written Decision dated Oct. 25, 2018.

*Spin Master Limited* v. *Alpha Animation & Toys Limited*, Claim No. HP-2018-000002, filed in European High Court of Justice Business and Property Court, Patents Court, Amended Grounds of Invalidity, Apr. 25, 2018, received Oct. 24, 2018.

Argos Catelog, "Coleco Princess Magic Tough Beauty Salon," No. 30, p. 306, 1988.

Bandai UK, Ltd, "Power Rangers Zeo DeLuxe Transforming Spring Action Warrior Wheel," copyright 1996.

(56) References Cited

OTHER PUBLICATIONS

Australian Patent Application 2007200737 Examiner's Report dated May 26, 2010.
Canadian Patent Application No. 2,547,539 Office Action dated Jan. 23, 2008.
European Patent Application 04256605.9 Search Report dated Oct. 31, 2005.
European Patent Application 07250653.8 Extended Search Report dated Jun. 25, 2007.
European Patent Application 07250653.8 Search Report dated Mar. 7, 2008.
European Patent Application 07250653.8 Office Action dated May 5, 2009.
PCT Patent Application Serial No. PCT/JP2007/053082 International Search Report dated May 15, 2007.
Petition for Inter Partes Review of U.S. Pat. No. 7,306,504, *Choirock Contents Factory Co., Ltd.* v. *Spin Master Ltd., et al.*, IPR No. IPR2017-00030, filed Oct. 7, 2016.
Tribunal Di Milano Filed by Choirock Contents Factory Co. Ltd. in Italy against EP Patent 1820548, Aug. 4, 2016.
U.S. Appl. No. 10/889,488 File History dated Jul. 12, 2004 through Nov. 21, 2007.
U.S. Appl. No. 11/644,913 File History dated Dec. 22, 2006 through Nov. 8, 2010.
U.S. Appl.No. 11/944,126 File History dated Nov. 21, 2007 through May 19, 2010.
U.S. Appl. No. 12/821,890 File History dated Jun. 23, 2010 through Jul. 17, 2013.
U.S. Appl. No. 13/939,033 File History dated Jul. 10, 2013 through Mar. 24, 2016.
Australian Patent Application AU2007200737 Notice of Acceptance dated Oct. 13, 2011.
Australian Patent Application AU 2007200737 Response to Examiner's First Report filed Sep. 26, 2011.
Canadian Patent Application No. 2,547,539 Applicant's Reply to Office Action filed Jul. 14, 2008.
European Patent Application 04256605.9 Office Action dated Aug. 23, 2006.
European Patent Application 04256605.9 Applicant's Reply to Office Action filed Jan. 31, 2007.
European Patent Application 04256605.9 Office Action dated Jun. 2, 2008.
European Patent Application 04256605.9 Applicant's Reply to Office Action filed Oct. 8, 2008.
European Patent Application 04256605.9 Notice of Intention to Grant issued Jun. 4, 2009.
European Patent Application 07250653.8 Applicant's Reply to Office Action Filed Jul. 16, 2008.
European Patent Application 07250653.8 Applicant's Reply to Office Action filed August 6, 200.
European Patent Application 07250653.8 Notice of Intention to Grant issued Oct. 9, 2009.
PCT Patent Application Serial No. PCT/JP2007/053082 Written Opinion dated May 15, 2007 (Annotated to show translation.
Chinese Patent Application No. 200780006093 Office Action dated Sep. 11, 2009.
Chinese Patent Application No. 200780006093 Response dated Jan. 26, 2010.
Chinese Patent Application No. 200780006093 Notice of Grant dated Jun. 3, 2010.
Japanese Patent Application No. 2006041918 Notice of Refusal dated Jun. 21, 2011.
Japanese Patent Application No. 2006041918 Amendment dated Aug. 5, 2011.
Japanese Patent Application No. 2006041918 Decision to Grant dated Oct. 11, 2011.
Japanese Patent Application No. 2008046476 Notice of Refusal dated Feb. 1, 2011.
Japanese Patent Application No. 2008046476 Amendment dated Jul. 29, 2011.
Japanese Patent Application No. 2008046476 Notice of Refusal dated Apr. 17, 2012.
Japanese Patent Application No. 2008046476 Notice of Refusal dated Feb. 26, 2013.
Korean Patent Application No. 10-2008-7020342 Notice of Refusal dated May 16, 2013.
Korean Patent Application No. 10-2008-7020342 Written Reply dated Aug. 16, 2013.
Korean Patent Application No. 10-2008-7020342 Notice of Refusal dated Dec. 27, 2013.
Korean Patent Application No. 10-2008-7020342 Written Reply dated Mar. 27, 2014.
Korean Patent Application No. 10-2008-7020342 Grant of Patent dated Jul. 30, 2014.
Mexican Patent Application No. MX/A/2008/010661 Response to Office Action dated Apr. 25, 2012.
Mexican Patent Application No. MX/A/2008/010661 Notice of Allowance dated May 23, 2012.
Japanese Patent Application No. 2008046476 Amendment dated Jul. 12, 2012.
Mexican Patent Application No. MX/A/2008/010661 Office Action dated Feb. 2, 2012.
Italian Patent Application TO2004A000796 filed Nov. 12, 2004, Machine Translation Attached.
1st Technical Brief filed in Tribunal Di Milano Filed by Choirock Contents Factory Co. Ltd. in Italy against EP Patent 1820548, filed Sep. 15, 2017, English Translation Attached.
*Choirock Contents Factory Co. Ltd.* v. *Spin Master*, Court of Milan, Italy, No. 53599/2016 Re EP 1820548; Second Technical Brief for Choirock Contents Factory Co. Ltd. dated Oct. 13, 2017, English Translation Attached.
*Choirock Contents Factory Co. Ltd.* v. *Spin Master*, Court of Milan, Italy, No. 53599/2016 Re EP 1820548; Second Technical Brief for Spin Master Ltd. dated Oct. 13, 2017, English Translation Attached.
*Spin Master Ltd.* v. *Alpha Group US LLC*, Case No. 18-cv-1046-RGK, pending in the United States District Court, Central District of California, Western Division, "Answer, Affirmative Defenses, and Counterclaims," Apr. 4, 2018.

* cited by examiner

TRANSFORMABLE TOY

RELATED APPLICATIONS

This application is a continuation of U.S. patent application Ser. No. 15/917,035, filed Mar. 9, 2018; which is a continuation of U.S. patent application Ser. No. 15/343,872, filed Nov. 4, 2016, now U.S. Pat. No. 9,975,058; which is a continuation of U.S. patent application Ser. No. 15/091,283, filed Apr. 5, 2016, now U.S. Pat. No. 9,868,073, issued Jan. 16, 2018; which is a continuation of U.S. patent application Ser. No. 13/939,033, filed Jul. 10, 2013, now U.S. Pat. No. 9,308,461, issued Apr. 12, 2016; which is a divisional of U.S. patent application Ser. No. 12/821,890, filed Jun. 23, 2010, now U.S. Pat. No. 8,500,508, issued Aug. 6, 2013; which is a continuation of U.S. patent application Ser. No. 11/644,913, filed Dec. 22, 2006, now U.S. Pat. No. 7,785,168, issued Aug. 31, 2010; which claims priority from Japanese Patent Application No. 2006-41918, filed Feb. 20, 2006. The above-referenced application(s) and patent(s) are hereby incorporated by reference into the present application in their entirety.

BACKGROUND

1. Field

The present invention relates to a toy, and in particular to a toy that transforms by means of the action of a magnetic force.

2. Description of the Related Art

Historically, there have been toys that have been proposed and that have come into practical use which have brought forth a variety of game effects by means of the action of a magnetic force. For example, there was a toy proposed, equipped with a doll furnished with a permanent magnet and a house frame furnished with a magnetic substance, which expanded by means of a magnetic force (refer to patent document 1, for example). In such a toy, in the event that the doll was brought near to the house frame, the expansion of the house frame and the opening of the door were automatically realized by means of the magnet furnished within the doll attracting the magnetic substance furnished within the house frame.

SUMMARY OF THE INVENTION

Although historical magnetic-force-expansion-style toys (the house frame toy, for example) like that defined in the said patent document 1 must have a mechanism installed within the interior thereof that acts by means of a magnetic force, because these toys can only be used by placing them in particular locations, there were few restrictions placed upon the shapes and sizes thereof in their design.

However, in the event that a shooting game is to be developed, for example, in which a shooter that shoots magnetic-force-expansion-style toys is used to send these toys running through a travel motion toy furnished with rails and various traps, although the miniaturization and amelioration of the toy itself is necessary, the following problems emerge under such circumstances.

Namely, in order to realize the miniaturization of magnetic-force-expansion-style toys, although both (1) space to incorporate a variety of mechanisms that operate by means of a magnetic force, and (2) space to house the expanded components, must be established, securing both of these spaces within the interior of a small toy involves considerable design difficulties. Further, in order to potentiate a shooting game in which magnetic-force-expansion-style toys are used, these toys must be given rollable shapes (spherical shapes, for example), but achieving the miniaturization of such toys while still employing rollable shapes involves considerable design difficulties, and this has not yet been realized by means of prior art.

The present invention is in consideration of such circumstances, and aims to dramatically increase the commercial value of the toy and impart fresh wonderment and intellectual excitement to its players by means of making the magnetic-force-expansion-style toy rollable.

In order to achieve the said aims, the toy pertaining to the present invention is characterized by being a toy equipped with an exterior structure constructed in such a way that it transforms from a rollable first shape to a second shape, and an interior structure contained within the interior of this exterior structure, and wherein the exterior structure is endowed with a transformation means that transforms the exterior locking portion and the exterior structure from the first shape to the second shape, and wherein the interior structure is endowed with a magnetic body that moves by means of a magnetic force that acts from the exterior of the toy, an interior locking portion that moves simultaneously with the movement of the magnetic body, and a biasing means that effects a force which moves or turns this interior locking portion in a particular direction, and wherein, in the event that a magnetic force does not act from the exterior of the toy, a locked state of the interior locking portion, which moved or turned in a particular direction by means of the force of the biasing means, and the exterior locking portion is realized, and the first shape of the exterior structure is thereby maintained, and wherein, on the contrary, in the event that a magnetic force has acted from the exterior of the toy, the magnetic body and the interior locking portion resist the force of the biasing means and move or turn, the locked state of the interior locking portion and the exterior locking portion is thereby released, and the exterior structure thereby transforms from the first shape to the second shape by means of the transformation means.

According to such a construction, in the event that a magnetic force does not act from the exterior of the toy, a locked state of the interior locking portion, which moved or turned in a particular direction by means of the force of the biasing means, and the exterior locking portion is realized, and the rollable first shape (a roughly spherical shape, for example) of the exterior structure is thereby maintained. On the contrary, in the event that a magnetic force has acted from the exterior of the toy, the magnetic body and interior locking portion resist the force of the biasing means and move or turn, the locked state of the interior locking portion and exterior locking portion is thereby released, and the exterior structure thereby transforms from the first shape to the second shape by means of the transformation means.

Namely, the toy can maintain the rollable first shape until a force (magnetic force) that attracts the magnetic body acts from the exterior of the toy. Consequently, the realization of games such as shooting games in which the toy pertaining to the present invention is sent running through a travel motion toy, for example, is potentiated. Further, simply by effecting a magnetic force from the exterior of the toy, the magnetic body and the interior locking portion within the interior of the toy move or turn, and the locked state of the interior locking portion of the interior structure and exterior locking portion of the exterior structure is thereby released, and the toy can hence automatically transform from the first shape to the second shape. Consequently, by positioning a magnet in a particular location on a travel motion toy, for example, the sudden transformation of the toy traveling on the travel motion toy in the rollable first shape to a different shape (the second shape), on this particular location, is potentiated. Further, because the mechanism for transforming the toy from the first shape to the second shape is relatively simple, the realization of the miniaturization of the toy is also potentiated. Hereby, the commercial value of the toy can be dramatically increased, and the impartation of fresh wonderment and intellectual excitement to its players is potentiated.

In the said toy, an interior locking portion, which moves integrally with the magnetic body in the interval between the central location and near-surface location of the toy in a rectilinear fashion, can be employed. In such an event, a biasing means, which effects a force that moves the interior locking portion from the near-surface location towards the central location of the toy, can be employed.

Further, in the said toy, the interior structure can be furnished with a first interior turning portion that turns integrally with the magnetic body upon a first interior turning axis, and a second interior turning portion that turns upon a second interior turning axis simultaneously with this first interior turning portion. In such an event, an interior locking portion that turns integrally with the second interior turning portion can be employed, as well as a biasing means that effects a force which turns the second interior turning portion and the interior locking portion in a particular direction.

Further, in the said toy, the exterior structure can be furnished with a first exterior turning component that turns upon a first exterior turning axis, and a second exterior turning component that turns upon a second exterior turning axis. In such an event, a transformation means that employs a turning means that effects a force which turns the first and second exterior turning components can be employed. Further, a construction can be employed in which, in the event that a magnetic force acts from the exterior of the toy and the locked state of the interior locking portion and exterior locking portion is released, the turning of the first exterior turning component and the turning of the second exterior turning component is realized, in this order.

Further, in the said toy, it is desirable for the exterior structure to employ a construction in which it is restorable from the second shape to the first shape, and in which, in the event that the exterior structure has been restored from the second shape to the first shape, a locked state of the interior locking portion and exterior locking portion is thereby realized, and the first shape of the exterior structure is thereby maintained once again.

If such a construction is employed, even after the toy has transformed from the first shape to the second shape by means of the action of a magnetic force, the toy can be restored to the rollable first shape and re-used, and games such as shooting games can hence be carried out repeatedly.

In another aspect, moreover, the present invention relates to a toy comprising a main body element and at least one first moveable element associated with said main body and moveable with respect thereto from a first position adjacent said main body, to a second position in which at least a portion of a said first moveable element has moved away from said main body, said at least one first moveable element being permanently biased toward said second position, and being provided with catch means co-operable with releasable latch means in said main body element to maintain at least one said first moveable element in said first position until said latch means is released.

Preferably, said main body element, together with said at least one first moveable element, are a first shape when said at least one first moveable element is in said first position, and a second shape when said at least one first moveable element is in said second position.

The first shape may be selected from the group consisting of spheres, cubes, tetrahedrons, pyramids, triangular prisms, egg shapes, parallelpipids, cylinders, discus shapes, toruses, teardrops, lozenges, animal shapes, planet shapes, robot shapes, vehicle shapes, building shapes, tree shapes, sports equipment related shapes, weapons shapes, character-head shapes, and the like.

In the most advantageous embodiment, the releasable latch is biased to a position in engagement with said catch.

Furthermore, the releasable latch will preferably be provided with a magnet, whereby said releasable latch may be moved out of engagement with said catch by attraction of said magnet to a ferrous or other magnetic metal surface, or a second magnet.

In a most preferred form of the present invention at least one second moveable element is hinged to said at least one first moveable element and moveable from a close position adjacent said at least one first moveable element, to an open position away from said at least one first moveable element, and said at least one second moveable element is biased toward said open position, and foldable to said closed position, said at least one second moveable element being restrained against movement toward said open position while said catch is in engagement with said releasable latch.

According to the present invention, because the magnetic-force-expansion-style toy can be made rollable, the commercial value of the toy can be dramatically increased, and the impartation of fresh wonderment and intellectual excitement to its players is potentiated.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWING FIGURES

Figure 1:
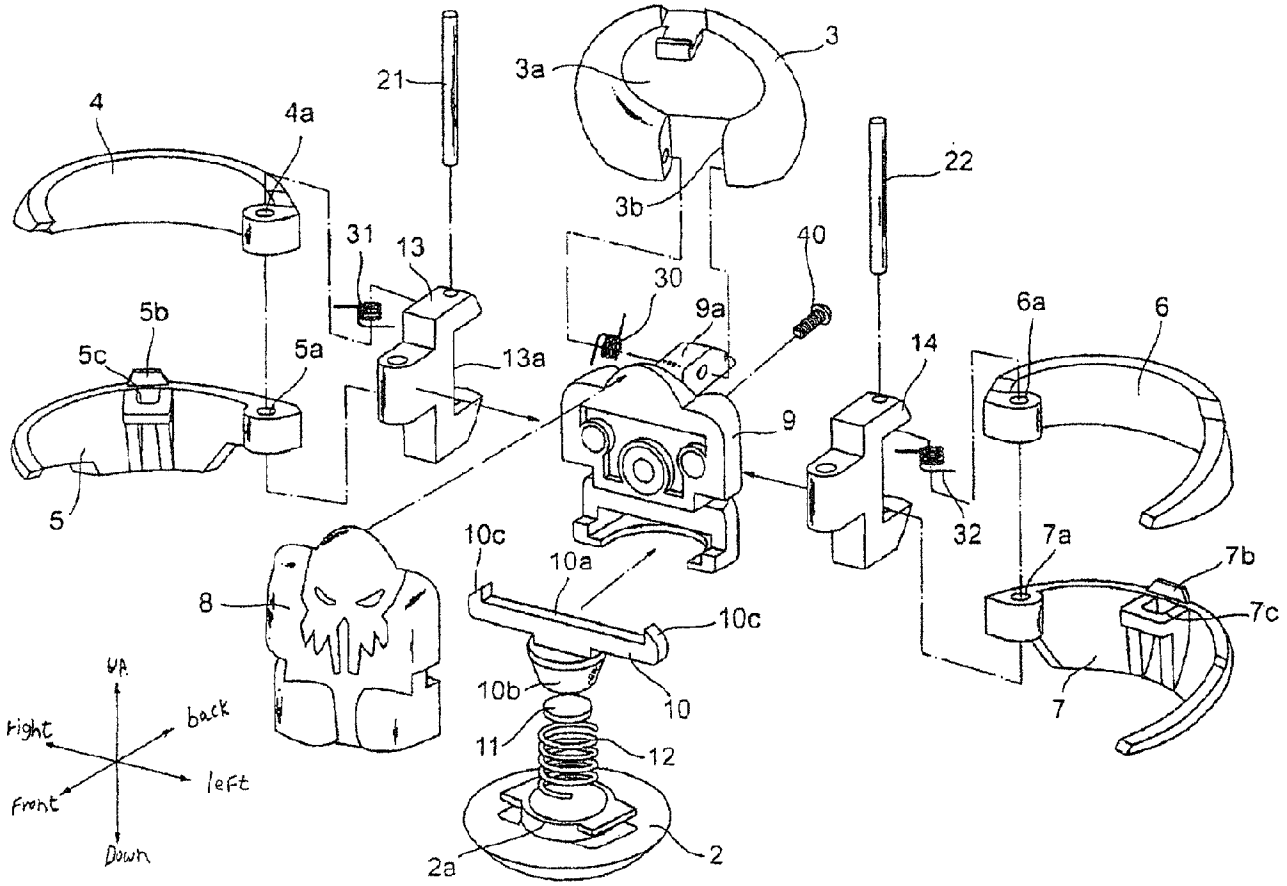
FIG. 1 is an exploded perspective view of the toy pertaining to embodiment 1 of the present invention.
Figure 2:
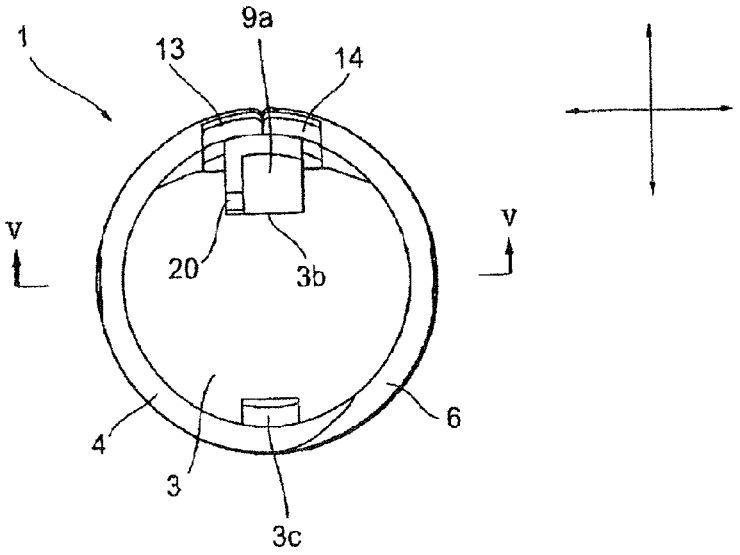
FIG. 2 is a plane view of the toy shown in drawing 1, showing a pre-transformation state.
Figure 3:
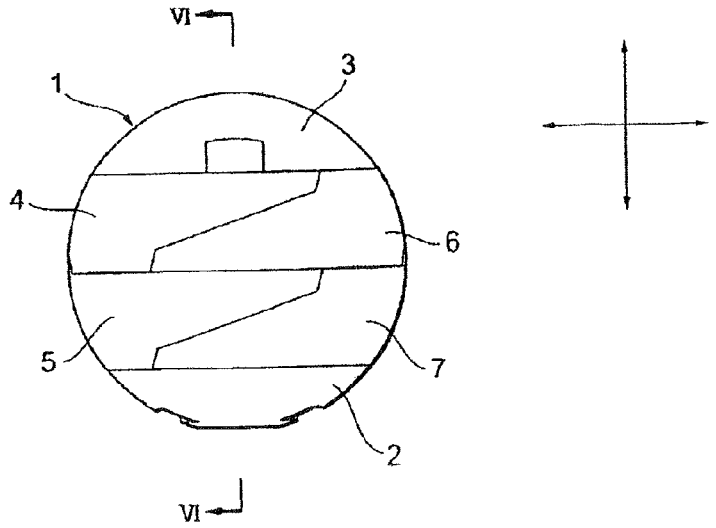
FIG. 3 is a front view of the toy shown in drawing 1, showing a pre-transformation state.
Figure 4:
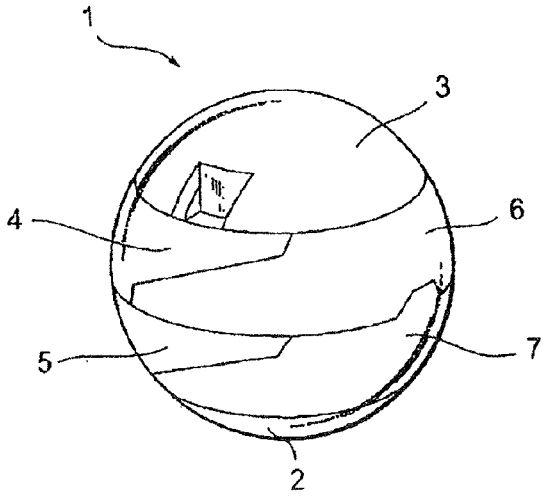
FIG. 4 is a perspective view of the toy shown in drawing 1, showing a pre-transformation state.
Figure 5A:
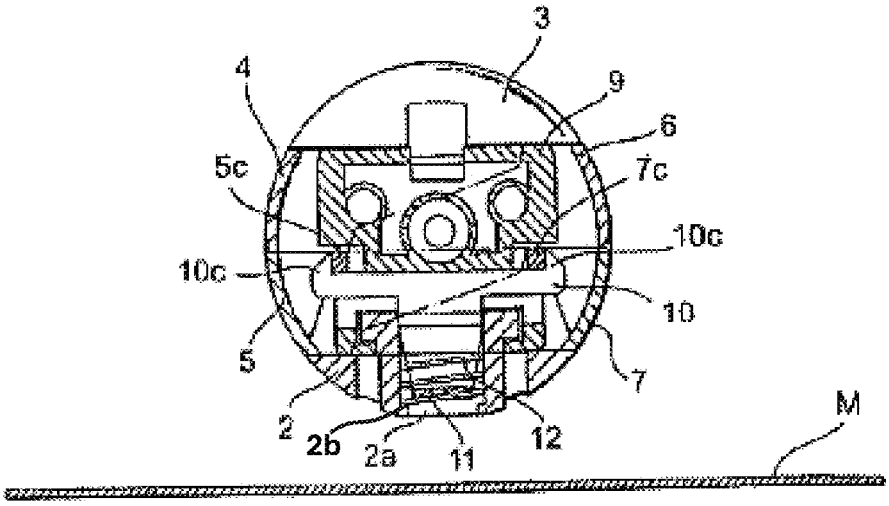
Figure 5B:
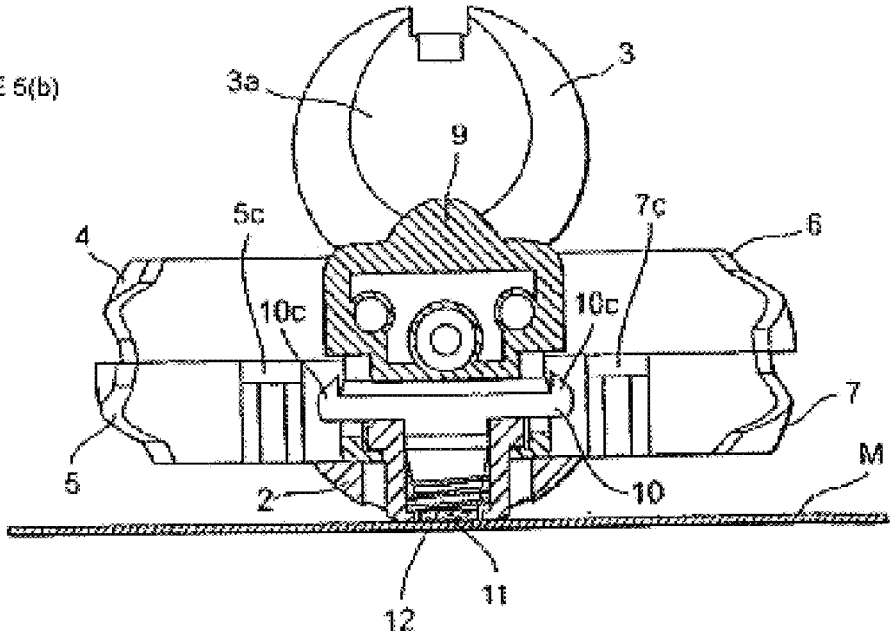
Figure 6A:
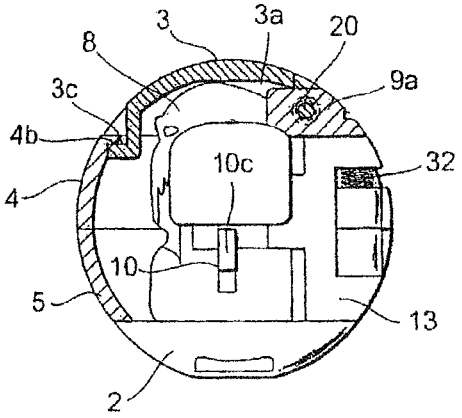
Figure 6B:
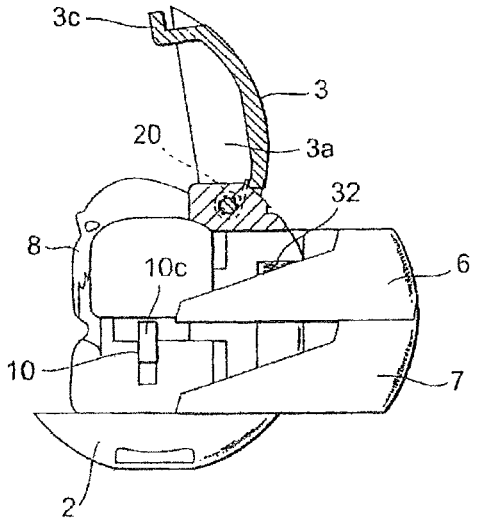
Figure 7:
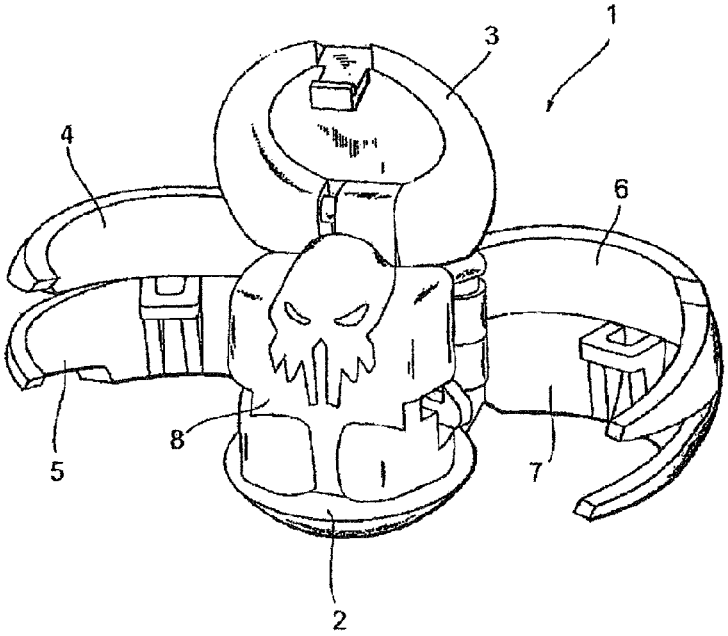
Figure 8:
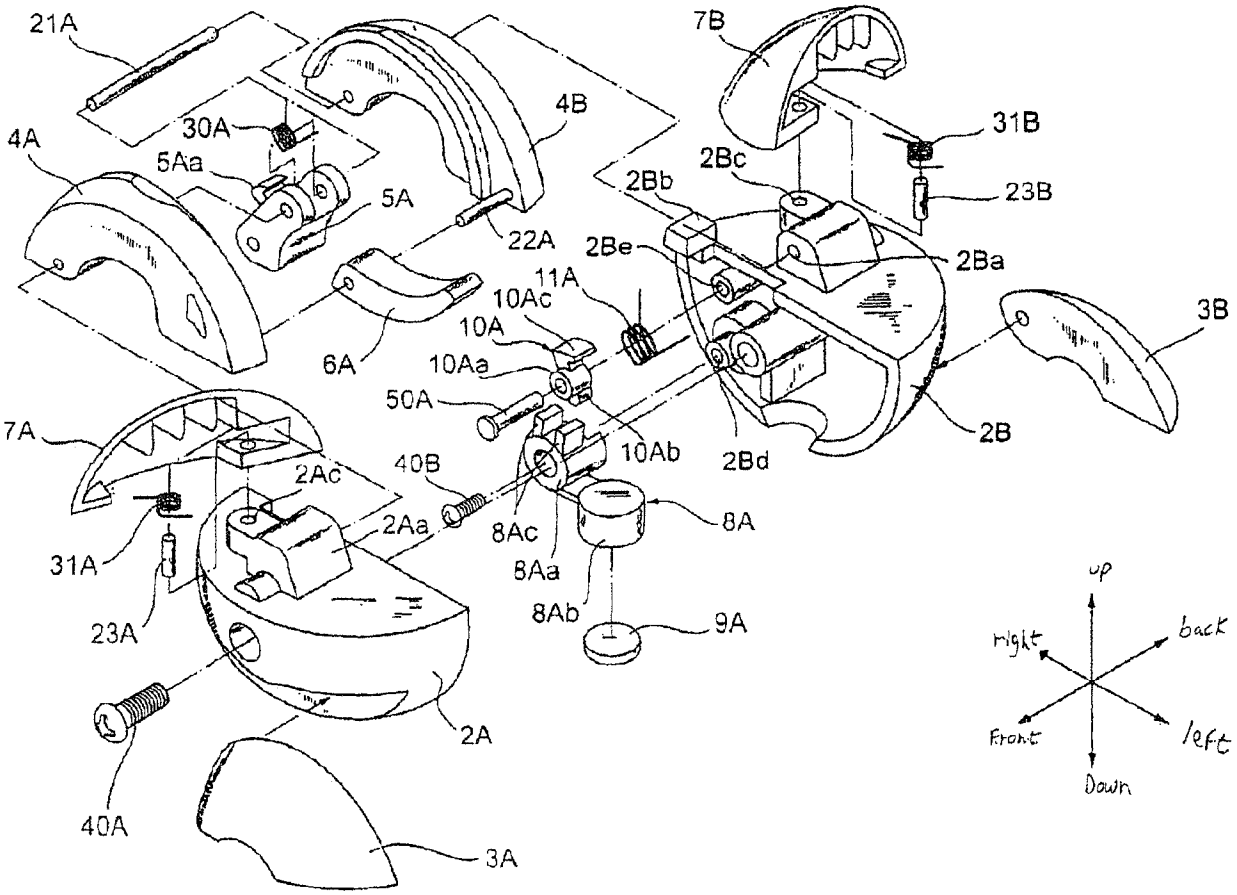
Figure 9:
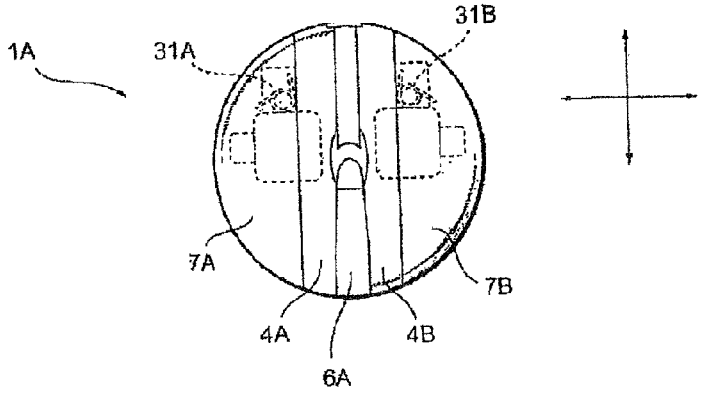
Figure 10:
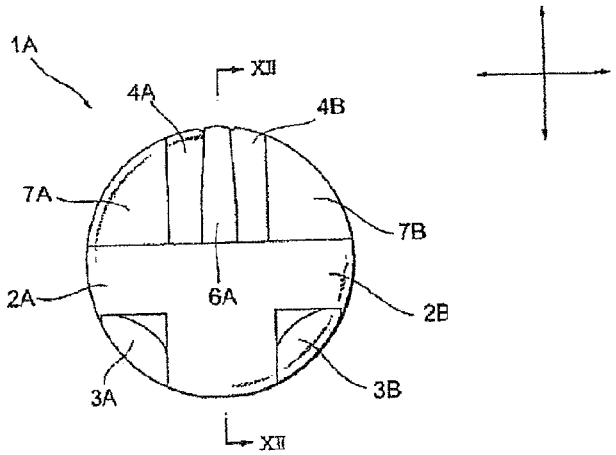
Figure 11:
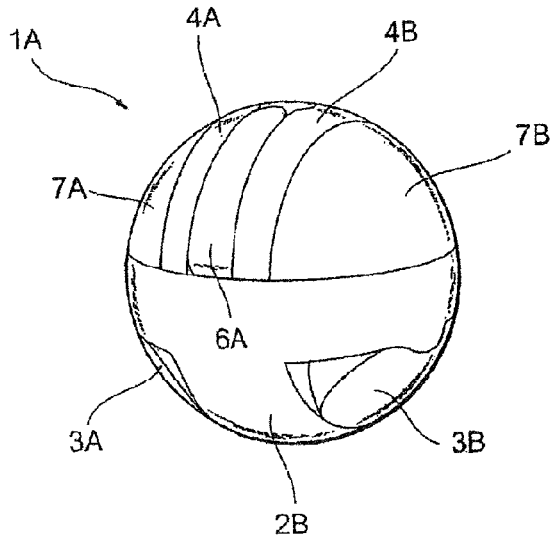
Figure 12A:
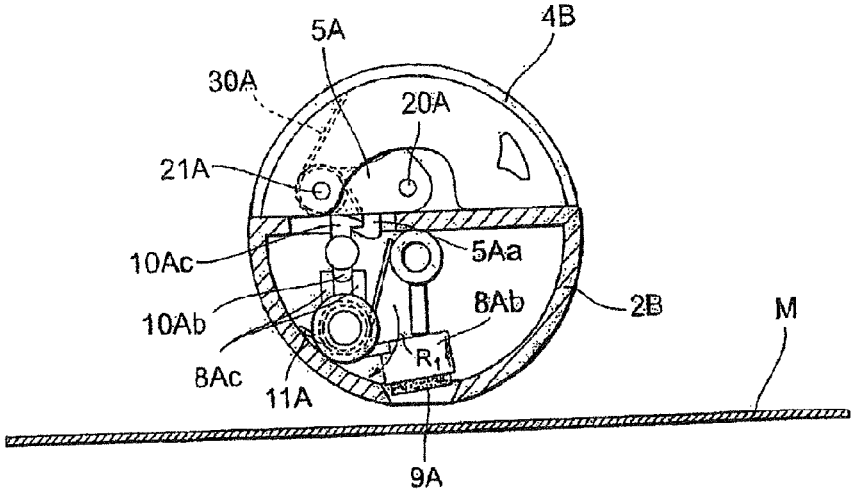
Figure 12B:
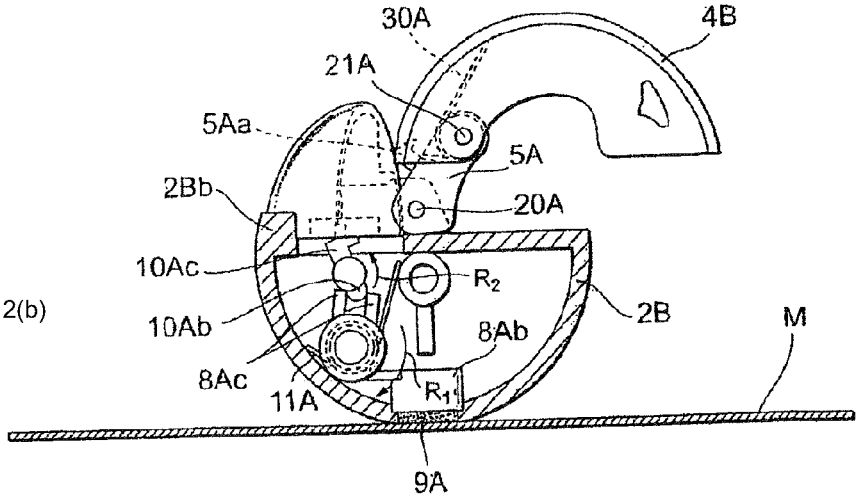
Figure 13:
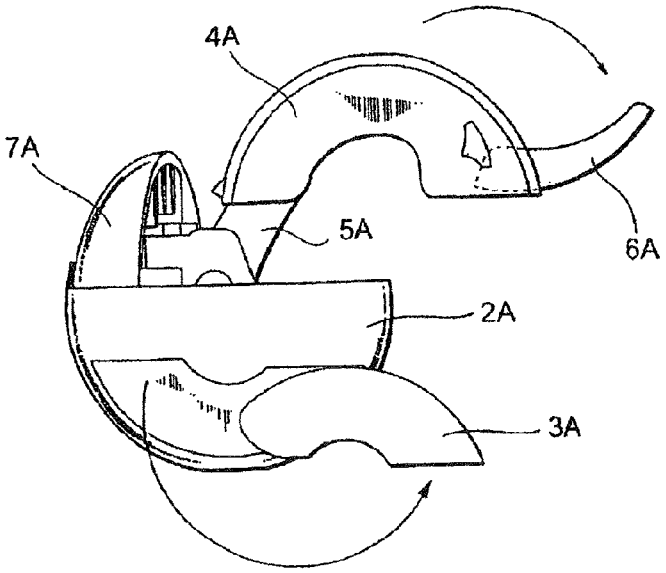
Figure 14:
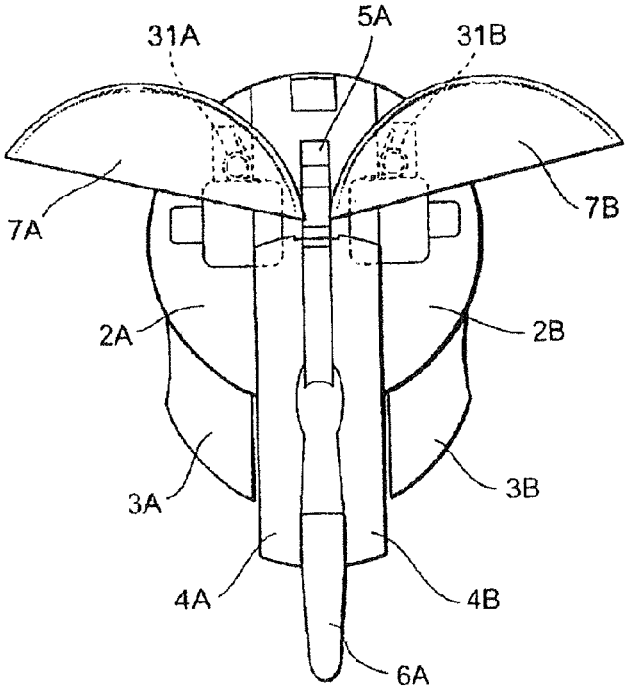
Figure 15:
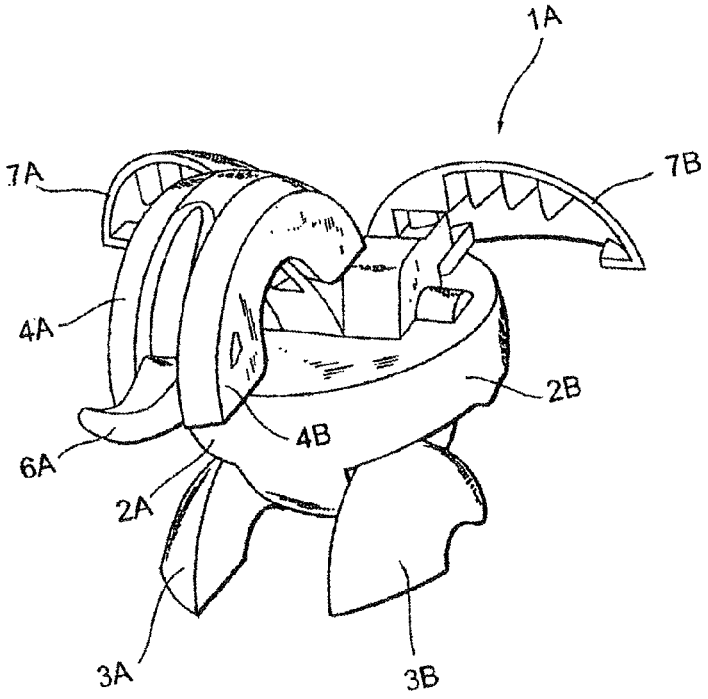

FIGS. 5(*a*) and 5(*b*) are two fragmentary sectional views of the V-V section in drawing 2 of the toy shown in drawing 1, (a) showing a pre-transformation state, and (b) showing a post-transformation state;

FIGS. 6(*a*) and 6(*b*) are two fragmentary sectional views of the VI-VI section in drawing 3 of the toy shown in drawing 1, (a) showing a pre-transformation state, and (b) showing a post-transformation state;

FIG. 7 is a perspective view of the toy shown in drawing 1, showing a post-transformation state;

FIG. 8 is an exploded perspective view of the toy pertaining to embodiment 2 of the present invention;

FIG. 9 is a plane view of the toy shown in drawing 8, showing a pre-transformation state;

FIG. 10 is a front view of the toy shown in drawing 8, showing a pre-transformation state;

FIG. 11 is a perspective view of the toy shown in drawing 8, showing a pre-transformation state;

FIGS. 12(*a*) and 12(*b*) are two fragmentary sectional views of the XII-XII section in drawing 10 of the toy shown in drawing 8, (a) showing a pre-transformation state, and (b) showing a post-transformation state;

FIG. 13 is a left side view of the toy shown in drawing 8, showing a post-transformation state;

FIG. 14 is a plane view of the toy shown in drawing 8, showing a post-transformation state; and FIG. 15 is a perspective view of the toy shown in drawing 8, showing a post-transformation state.

DETAILED DESCRIPTION

Toy 1 pertaining to embodiment 1 of the present invention shall be described below with reference to drawings 1-7. Toy 1 pertaining to the present embodiment is an item that transforms from a rollable, spherical shape (the first shape: drawings 2-4) to a fictitious character shape (the second shape: drawing 7) symbolizing a "malevolent angel" by means of the action of a magnetic force.

Firstly, the construction of toy 1 pertaining to the present embodiment shall be described.

As shown in drawings 1-4, toy 1 is constructed of an exterior structure assigned to the exterior of toy 1, which forms an overall spherical shape, and an interior structure contained within the interior of the exterior structure. The exterior structure is endowed with a lower component 2 that constitutes the lower section of toy 1, an upper component 3 that constitutes the upper section of toy 1, and 4 lateral components 4-7 that constitute the circular section forming the upper and lower central region of toy 1. Further, the interior structure is endowed with a front component 8 assigned to the front interior location of toy 1, which constitutes the anterior portion of the character, a back component 9 assigned to the back interior location of toy 1, which constitutes the posterior portion of the character, a locking component 10 assigned to the interval between front component 8 and back component 9, a magnet 11 fixed to the lower end of locking component 10, a spring 12 that effects a force which moves locking component 10 upwardly, and support components 13 and 14 assigned to the left and right rear of back component 9, which support lateral components 4-7.

As shown in drawings 1-3, lower component 2 of the exterior structure expresses a slight dome shape, as if it were a section of a sphere that has been cut off, and the exterior surface thereof constitutes one section (the lower section) of the spherical shape. As shown in drawings 1 and 5, a circular through-hole 2*a* is furnished in the central region of lower component 2. Locking component 10, magnet 11 and spring 12 of the interior structure are assigned to the interior space of through-hole 2*a* in such a way that they can move in the interval between the central location and near-surface location of toy 1 in a rectilinear fashion. Here, as shown in drawing 5, there is a space formed for the movement of the magnet in the interval between magnet 11 and the near-surface vicinity of toy 1. Locking component 10 etc. for these components shall be described in detail below.

As shown in drawings 1-3, upper component 3 of the exterior structure expresses a slight dome shape, as if it were a section of a sphere that has been cut off, and the exterior surface thereof constitutes one section (the upper section) of the spherical shape. As shown in drawings 1 and 6, concave portion 3*a* is formed within the interior of upper component 3 in order to contain front component 8 and the upper portion of back component 9 (the head portion of the character). Further, as shown in drawings 1 and 2, notch portion 3*b* is furnished in the marginal portion of upper component 3. Back protruding portion 9*a* of back component 9 of the interior structure is inlaid in this notch portion 3*b*. And, as shown in drawing 2, upper component 3 is connected to back protruding portion 9*a* of back component 9 through turning axis 20 in such a way that it can turn. Here, upper component 3 is biased in such a way that it turns upwardly (namely, the direction in which it separates with respect to back component 9) by means of the elastic force of spring 30 assigned to the interval between upper component 3 and back component 9.

Further, as shown in drawings 1 and 6, cross section L-shaped convex portion 3*c* is furnished in the location opposite notch portion 3*b* of the marginal portion of upper component 3, and this convex portion 3*c* is such that it locks onto convex portion 4*b* of lateral component 4. As shown in drawing 6(*a*), in the event that lateral component 4 is closed, upper component 3 does not turn upwardly due to convex portion 3*c* of upper component 3 being locked onto convex portion 4*b* of lateral component 4. On the contrary, as shown in drawing 6(*b*), in the event that lateral component 4 is opened laterally, upper component 3 turns upwardly by means of the elastic force of spring 30, due to the locked state of convex portion 3*c* of upper component 3 and concave portion 4*b* of lateral component 4 being released.

As shown in drawing 1 etc., lateral components 4-7 of the exterior structure are husk-shaped components with a roughly circular arc shape, endowed with a particular thickness and width, and the exterior surfaces thereof constitute one section (the circular section forming the upper and lower central region) of the spherical shape by means of them combining. Bearing portions 4*a*-7*a* are furnished on one end of lateral components 4-7. The respective bearing portions 4*a* and 5*a* of the two upper and lower lateral components 4 and 5, which are assigned to the right side in drawings 1 and 3, etc., are inlaid in notch portion 13*a* of support component 13. And, these right-side lateral components 4 and 5 are connected to support component 13 through turning axis 21. Here, lateral component 4 is biased in such a way that it turns outwardly (namely, the direction in which it opens) by means of the elastic force of spring 31, which is assigned to the interval between lateral component 4 and support component 13. On the contrary, the respective bearing portions 6*a* and 7*a* of the two upper and lower lateral components 6 and 7, which are assigned to the left side in drawings 1 and 3, etc., are inlaid in notch portion 14*a* of support component 14. And, these left-side lateral components 6 and 7 are connected to support component 14 through turning axis 22. Here, lateral component 6 is biased in such a way that it turns outwardly (namely, the direction in which it opens) by means of the elastic force of spring 32, which is assigned to the interval between lateral component 6 and support component 14.

Further, protrusions 5*b* and 7*b* are respectively furnished on the upper side of the two left and right lateral components 5 and 7, which are assigned to the lower section in drawings 1 and 3, etc. Protrusion 5*b* of right side lateral component 5, which is assigned to the lower section, is inlaid in a groove portion of right side lateral section 4, which is assigned to the upper section, and is not shown in the drawings. By means of this, when upper right side lateral component 4 turns upon turning axis 21 by means of the elastic force of spring 31, lower right side lateral component 5 turns integrally with this lateral component 4. Further, protrusion 7*b* of left side lateral section 7, which is assigned to the lower section, is inlaid in a groove portion of left side lateral section 6, which is assigned to the upper section, and is not shown in the drawings. By means of this, when upper left side lateral component 6 turns upon turning axis 22 by means of the elastic force of spring 32, lower left side lateral component 7 turns integrally with this lateral component 6.

Further, as shown in drawings 1 and 5, U-shaped exterior locking portions 5*c* and 7*c*, which are respectively locked by the two left and right interior locking portions 10*c* and 10*c* of locking component 10 of the interior structure, are furnished on the inner side of the two left and right lateral components 5 and 7, which are assigned to the lower section in drawings 1 and 3, etc. As shown in drawing 5(*a*), in the event that a magnetic force has not acted on toy 1 and locking component 10 of the interior structure is upwardly biased by means of the elastic force of spring 12, lateral components 5 and 7 do not turn outwardly, due to exterior locking portion 5*c* of right side lateral component 5 and exterior locking portion 7*c* of left side lateral component 7 being locked respectively onto right side interior locking portion 10*c* and left side interior locking portion 10*c*. On the contrary, as shown in drawing 5(*b*), in the event that a magnetic force has acted on toy 1 and locking component 10 of the interior structure has moved downwardly, lateral components 4 and 6 (and lateral components 5 and 7, which turn simultaneously therewith) turn outwardly by means of the elastic force of springs 31 and 32, due to the locked state of interior locking portions 10*c* and 10*c* of locking component 10 and exterior locking portions 5*c* and 7*c* of lateral components 5 and 7 being released.

Furthermore, lateral components 4-7 of the exterior structure correspond to the first exterior turning component in the present invention, and turning axes 21 and 22 correspond to the exterior turning axes in the present invention. Further, upper component 3 corresponds to the second exterior turning component in the present invention, and turning axis 20 corresponds to the second exterior turning axis in the present invention. Further, spring 30, which effects a force that turns upper component 3, and springs 31 and 32, which effect a force that turns lateral components 4-7, correspond to the turning means and transformation means in the present invention.

As shown in drawings 1 and 5, front component 8 and back component 9 of the interior structure are assigned to the upper section of lower component 2 of the exterior structure, and constitute the body portion and head portion of the character by means of being combined and held together by screw 40. As shown in drawing 5, there is a space formed within in the interior of the back portion, which is constructed of the combination of front component 8 and back component 9, in order to house the vertical movement of locking component 10. This space is formed from the central location of toy 1 towards the near-surface location of toy 1 in such a way that it is in communication with the interior space of through-hole 2*a* of lower component 2, and is such that this space and magnet 11 are aligned in a near-rectilinear fashion. Further, support components 13 and 14 are mounted onto the left and right rear of back component 9.

As shown in drawings 1 and 5 etc., locking component 10 of the interior structure expresses a roughly T-shape and is endowed with a left-and-right extending portion 10*a* that extends in the left and right directions, and a tapered tubular portion 10*b* that extends downwards from the center of left-and-right extending portion 10*a*. And, interior locking portions 10*c* and 10*c* are furnished on both ends of left-and-right extending portion 10*a*, and magnet 11 is fixed onto the bottom end of tapered tubular portion 10*b*. Interior locking portions 10*c* and 10*c* are respectively locked onto exterior locking portions 5*c* and 7*c* of the exterior structure. As shown in drawing 5, magnet 11 is assigned to a location near the surface of toy 1 (the surface of lower component 2 of the exterior structure). As shown in drawing 5, the lower end of spring 12 in the form of a coil spring is supported by means of support portion 2*b*, which is furnished on through-hole 2*a* of lower component 2, and is effected by an elastic force that propels the peripheral surface of tapered tubular portion 10*b* of locking component 10 upwardly, noting that the coil of spring 12 surrounds the magnet 11 and the tubular portion 10*b* of locking component 10. Furthermore, magnet 11 corresponds to the magnetic body in the present invention, and spring 12 corresponds to the biasing means in the present invention.

Next, the transformation action of toy 1 pertaining to the present embodiment shall be described.

In the event that no metallic or other magnetic substance exists near magnet 11 of the interior structure of toy 1, magnet 11 does not move by means of a magnetic force, and locking component 10 is thereby maintained in a state of being pressed from the exterior towards the central region of toy 1 by means of the elastic force of spring 12 of the interior structure. As shown in drawing 5(*a*), in this state, exterior locking portions 5*c* and 7*c* of the exterior structure are locked by the left and right interior locking portions 10*c* and 10*c* of locking component 10 of the interior structure, and the spherical shape (the first shape) of the exterior structure as shown in drawings 2-4 is thereby maintained.

On the contrary, as shown in drawing 5(*b*), in the event that a metallic or other magnetic substance (metal-embedded card M) exists near magnet 11 of the interior structure of toy 1, a magnetic force that attracts magnet 11 and the magnetic substance acts. By means of the action of such a magnetic force, magnetic 11 and locking component 10 of the interior structure of toy 1 resist the elastic force of spring 12 and move integrally from the central location towards the exterior of toy 1, and the locked state of the left and right interior locking portions 10*c* and 10*c* of locking component 10 of the interior structure and exterior locking portions 5*c* and 7*c* of the exterior structure is thereby released.

Hereby, the exterior structure transforms to the character shape (the second shape) as shown in drawing 7 by means of springs 30, 31 and 32. Here, first, the locked state of interior locking portions 10*c* and 10*c* and exterior locking portions 5*c* and 7*c* is released, and lateral components 4-7 turn by means of the force of springs 31 and 32. Next, as shown in drawing 6(*b*), upper component 3 turns upwardly by means of the elastic force of spring 30, due to the locked state of convex portion 3*c* of upper component 3 and concave portion 4*b* of lateral component 4 being released by means of the turning of lateral components 4-7.

Further, to restore the shape of toy 1 from the character shape (the second shape) to the spherical shape (the first shape), first, work against the elastic force of spring 30 and turn upper component 3 of the exterior structure downwardly. Next, work against the elastic force of springs 31 and 32 and turn lateral components 4-7 of the exterior structure towards the front central area, lock convex portion 3*c* of upper component 3 and concave portion 4*b* of lateral component 4 while also locking exterior locking portions 5*c* and 7*c* of the exterior structure and interior locking portions 10*c* and 10*c* of the interior structure. By means of such an operation, the shape of the exterior structure of toy 1 is restored to a spherical shape. And, the spherical shape of toy 1 is maintained until a magnetic force acts once again.

In toy 1 pertaining to the embodiment described above, toy 1 can maintain a rollable, spherical shape (the first shape) until a force (magnetic force) that attracts magnet 11 acts from the exterior of toy 1. Consequently, the realization of games such as shooting games in which toy 1 pertaining to the present embodiment is sent running through a travel motion toy, for example, is potentiated. Further, simply by effecting a magnetic force from the exterior of toy 1, magnet 11 and locking component 10 within the interior of toy 1 move, and the locked state of interior locking portions 10*c* and 10*c* of the interior structure and exterior locking portions 5*c* and 7*c* of the exterior structure is thereby released, and toy 1 can hence automatically transform from the spherical shape to the character shape (the second shape). Consequently, by positioning a metallic etc. magnet in a particular location on a travel motion toy, for example, the sudden transformation of toy 1 traveling on the travel motion toy in a rollable, spherical shape to a different shape (the second shape), on this particular location, is potentiated. Further, because the mechanism for transforming toy 1 is relatively simple, the realization of the miniaturization of the toy is also potentiated. Hereby, the commercial value of the toy can be dramatically increased, and the impartation of fresh wonderment and intellectual excitement to its players is potentiated.

Further, in toy 1 pertaining to the embodiment described above, the exterior structure is constructed in such a way that it is restorable from the character shape (the second shape) to the spherical shape (the first shape), and moreover, in the event that the exterior structure has been restored to the spherical shape, a locked state of interior locking portions 10*c* and 10*c* and exterior locking portions 5*c* and 7*c* is realized, and this spherical shape is thereby maintained once again. Consequently, even after toy 1 has transformed from the spherical shape to the character shape by means of the action of a magnetic force, toy 1 can be restored to a rollable, spherical shape and re-used, and games such as shooting games can hence be carried out repeatedly.

Embodiment 2

Next, toy 1A pertaining to embodiment 2 of the present invention shall be described with reference to drawings 8-15. Toy 1A pertaining to the present embodiment is an item that transforms from a rollable, spherical shape (the first shape: drawings 9-11) to a fictitious character shape (the second shape: drawings 13-15) symbolizing a "fiendish dragon" by means of the action of a magnetic force.

Firstly, the construction of toy 1A pertaining to the present embodiment shall be described.

As shown in drawings 8-11, toy 1A is constructed of an exterior structure assigned to the exterior of toy 1A, which forms an overall spherical shape, and an interior structure contained within the interior of the exterior structure. The exterior structure is endowed with hemispherical structure components 2A and 2B that constitute the hemispherical portion assigned to the lower section of toy 1A, leg components 3A and 3B mounted onto the lower section of the hemispherical portion of toy 1A in such a way that they are turnable, central turning components 4A and 4B mounted onto the upper central portion of the hemispherical portion of toy 1A in such a way that they are turnable, and lateral turning components 7A and 7B etc. mounted onto the upper left and right lateral portions of the hemispherical portion of toy 1A in such a way that they are turnable. Further, the interior structure is endowed with an interior turning component 8A assigned to the interior of the hemispherical portion of toy 1A in such a way that it is turnable, a magnet 9A fixed to the lower section of interior turning component 8A, a turning locking component 10A that turns simultaneously with the turning of interior turning component 8A, a spring 11 that effects a force which turns turning locking component 10A in a particular direction, etc.

As shown in drawing 8, hemispherical structure components 2A and 2B of the exterior structure express a shape as if a hemisphere has been cut down the middle, and together constitute a hemispherical portion by means of being combined and held together by bolt 40A. A hollow portion is formed within the hemispherical portion, which is constructed by means of hemispherical structure components 2A and 2B, and interior turning component 8A, magnet 9A, turning locking component 10A, etc. of the interior structure are contained within this hollow portion. Further, a hole portion is formed on the lower section of the hemispherical portion, which is constructed by means of hemispherical structure components 2A and 2B, and is such that magnet 9A is exposed to the exterior from this hole portion. Interior turning component 9A etc. shall be described in detail below.

As shown in drawings 8 and 10, leg components 3A and 3B of the exterior structure are the parts that correspond to the leg portions of the character, and are connected to the lower lateral portions of hemispherical structure components 2A and 2B in such a way that they are turnable upon the respective turning axes thereof. As shown in drawings 13 and 15, leg components 3A and 3B can be used as the leg portions of the character by means of the player grasping a section thereof with his/her fingers and turning it approximately 180. degree. Further, as shown in drawings 10 and 11, in the event that leg components 3A and 3B are not used as the leg portions, the exterior surfaces of leg components 3A and 3B are such that they constitute one section of the spherical shape.

As shown in drawings 8-10, central turning components 4A and 4B of the exterior structure are roughly circular arc-shaped components endowed with a particular thickness, and the peripheral surfaces thereof constitute one section of the spherical shape. As shown in drawings 8 and 12, central turning components 4A and 4B are connected to hemispherical structure components 2A and 2B through connecting turning component 5A. First bearing portions 2Aa and 2Ba are furnished on the upper portion of hemispherical structure components 2A and 2B so that they connect to connecting turning component 5A respectively through left-and-right direction turning axis 20A (drawing 12) in such a way that they are turnable. One end of connecting turning component 5A is connected to the first bearing portions 2Aa and 2Ba of these hemispherical structure components 2A and 2B through turning axis 20A in such a way that it is turnable. Further, the other end of connecting turning component 5A is connected to one end of central turning components 4A and 4B through turning axis 21A in such a way that it is turnable. Here, connecting turning component 5A is assigned to the interval between central turning components 4A and 4B in such a way that is inserted therebetween.

Further, central turning components 4A and 4B are biased in such a way that they turn backwardly by means of the elastic force of spring 30 assigned to the interval between connecting turning component 5A and central turning components 4A and 4B.

Further, as shown in drawings 8 and 12, L-shaped exterior locking portion 5Aa, which is locked onto interior locking portion 10Ac of turning locking component 10A of the interior structure, is furnished on connecting turning component 5A. As shown in drawing 12(*a*), in the event that a magnetic force does not act on toy 1A and interior locking portion 10Ac of the interior structure turns forwardly by means of the elastic force of spring 11A, connecting turning component 5A and central turning components 4A and 4B do not turn upwardly, due to exterior locking portion 5Aa of connecting turning component 5A being locked onto interior locking component 10Ac. On the contrary, as shown in drawing 12(*b*), in the event that a magnetic force has acted on toy 1A and interior locking portion 10Ac of the interior structure has turned backwardly, central turning components 4A and 4B turn backwardly by means of the elastic force of spring 30A, due to the locked state of interior locking portion 10Ac and exterior locking portion 5Aa being released. Hereupon, the exterior surfaces of central turning components 4A and 4B abut against convex portion 2Bb furnished on the backside of hemispherical structure component 2B, and central turning components 4A and 4B and connecting turning component 5A are propelled upwardly by means of the reactive force from this convex portion 2Bb. Further, central turning components 4A and 4B are pushed forwardly by means of the respective back end portions of lateral turning components 7A and 7B, which turn by means of the elastic force of springs 31A and 31B. Hereby, central turning components 4A and 4B and connecting turning component 5A turn upwardly and forwardly.

Further, horn component 6A is connected in the interval between central turning components 4A and 4B through turning axis 22A in such a way that it is turnable. As shown in drawings 13-15, horn component 6A can be used as the horn portion of the character by means of the player grasping the tip thereof with his/her fingers and turning it a predetermined angle. As shown in drawings 9-11, in the event that horn component 6A is not used as the horn portion, the exterior surface of horn component 6A is such that it constitutes one section of the spherical shape.

As shown in drawings 8-11 etc., lateral turning components 7A and 7B of the exterior structure express a shape as if a hemisphere has been cut down the middle, and the size thereof is slightly smaller than that of hemispherical structure components 2A and 2B. As shown in drawings 8 and 14, lateral turning components 7A and 7B are connected to the upper portion of hemispherical structure components 2A and 2B in such a way that they are turnable. Second bearing portions 2Ac and 2Bc are furnished on the upper portion of hemispherical structure components 2A and 2B so that they connect to lateral turning components 7A and 7B respectively through up-and-down direction turning axes 23A and 23B in such a way that they are turnable. One end of lateral turning components 7A and 7B is connected to the second bearing portions 2Ac and 2Bc of these hemispherical structure components 2A and 2B through turning axes 23A and 23B in such a way that they are turnable. Here, lateral turning components 7A and 7B are biased in such a way that they turn backwardly by means of the elastic force of springs 31A and 3B assigned to the interval between lateral turning components 7A and 7B and hemispherical structure components 2A and 2B.

As shown in drawing 12(*a*), in the event that a magnetic force does not act on toy 1A and central turning components 4A and 4B and connecting turning component 5A do not turn, lateral turning components 7A and 7B do not turn, due to the respective back end portions of lateral turning components 7A and 7B abutting against the respective back end portions of central turning components 4A and 4B. On the contrary, in the event that a magnetic force has acted on toy 1A and central turning components 4A and 4B have turned upwardly, the turning of lateral turning components 7A and 7B is allowed, due to a slight gap on the back sections of the respective back end portions of central turning components 4A and 4B, into which the respective back end portions of lateral turning components 7A and 7B can enter, being formed. And, central turning components 4A and 4B, which were pushed forwardly by means of the respective back end portions of lateral turning components 7A and 7B, then turn upwardly and forwardly.

Furthermore, central turning components 4A and 4B and connecting turning component 5A of the exterior structure correspond to the first exterior turning components in the present invention, and turning axes 20A and 21A correspond to the first exterior turning axes in the present invention. Further, lateral turning components 7A and 7B correspond to the second exterior turning components in the present invention, and turning axes 23A and 23B correspond to the second exterior turning axes in the present invention. Further, spring 30A, which effects a force that turns central turning components 4A and 4B, and springs 31A and 31B, which effect a force that turns lateral turning components 7A and 7B, correspond to the turning means and transformation means in the present invention.

As shown in drawings 8 and 12 etc., interior turning component 8A of the interior structure is endowed with large circular tubular portion 8Aa, extending portion 8Ab furnished in such a way that it extends in one direction from large circular tubular portion 8Aa, and two protrusions 8Ac and 8Ac furnished in such a way that they extend from large circular tubular portion 8Aa in a roughly perpendicular direction to the extension direction of extending portion 8Ab. Large circular tubular portion 8Aa of interior turning component 8A is connected with bolt 40B to turning axis portion 2Bb, which is furnished in the interior of hemispherical structure component 2B. By means of this, interior turning component 8A is turnable upon the left-and-right direction turning axis (the first interior turning axis). Further, magnet 9A is fixed on the lower end of extending portion 8Ab of interior turning component 8A. As shown in drawing 12, magnet 9A is assigned to a location near the surface of toy 1A (the surface of hemispherical structure components 2A and 2B of the exterior structure). Further, as shown in drawing 12, a space only allowing for magnet 9A to turn is furnished in the interval between magnet 9A and the near-surface location of toy 1A, and this space and magnet 9A are positioned in a near-rectilinear fashion in the interval between the central location of toy 1A and the near-surface location of toy 1A.

As shown in drawings 8 and 12 etc., turning locking component 10A of the interior structure is endowed with small circular tubular portion 10Aa, protruding portion 10Ab furnished in such a way that it protrudes in one direction from small circular tubular portion 10Aa, and L-shaped interior locking portion 10Ac furnished in such a way that it extends from small circular tubular portion 10Ac in an opposite direction to protruding portion 10Ab. Small circular tubular portion 10Aa of turning locking component 10A is connected through pin 50A to interior bearing portion 2Be, which is furnished in the interior of hemispherical structure component 2B. By means of this, turning locking component 10A is turnable upon the left-and-right direction turning axis (the second interior turning axis). Here, turning locking component 10A is biased in such a way that it turns in a particular direction (the direction in which interior locking portion 10Ac, which is positioned on the upper section, turns forwardly) by means of the elastic force of spring 11A, which is assigned to the interval between turning locking component 10A and hemispherical structure component 2B. As shown in drawing 12, protruding portion 10Ab of turning locking component 10A is inlaid in the interval between the two protrusions 8Ac and 8Ac of interior turning component 8A in such a way that it is swingable. Further, interior locking portion 10Ac of interior turning component 8A is locked onto exterior locking portion 5Aa of connecting turning component 5A of the exterior structure. Furthermore, interior turning component 8A of the interior structure corresponds to the first interior turning portion in the present invention, turning locking component 10A corresponds to the second interior turning portion in the present invention, and spring 11A corresponds to the biasing means in the present invention.

Next, the transformation action of toy 1A pertaining to the present embodiment shall be described.

In the event that no metallic or other magnetic substance exists near magnet 9A of the interior structure of toy 1A, magnet 9A does not move by means of a magnetic force, and turning locking component 10A is thereby maintained in a state of being biased in a particular direction (the direction in which interior locking portion 10Ac, which is positioned on the upper section, turns forwardly) by means of the elastic force of spring 11A of the interior structure. As shown in drawing 12(*a*), in this state, exterior locking portion 5Aa of connecting turning component 5A of the exterior structure is locked by interior locking portion 10Ac of turning locking component 10A of the interior structure, and the spherical shape of the exterior structure as shown in drawings 9-11 is thereby maintained.

On the contrary, as shown in drawing 12(*b*), in the event that a metallic or other magnetic substance (metal-embedded card M) exists near magnet 9A of the interior structure of toy 1A, a magnetic force that attracts magnet 9A and the magnetic substance acts. By means of this, magnet 9A of the interior structure and interior turning component 8A of the interior structure of toy 1A turn integrally in direction R1 of drawing 12. When interior turning component 8A turns in such a way, protruding portion 10Ab of turning locking component 10A, which is inlaid in the two protrusions 8Ac and 8Ac of interior turning component 8A, swings forwardly, and the locked state of interior locking portion 10Ac of turning locking component 10A and exterior locking portion 5Aa of connecting turning component 5A is released due to turning locking component 10A turning in direction R2 of drawing 12.

Hereby, the exterior structure transforms to the character shape (the second shape) as shown in drawings 13-15 by means of springs 30A, 31A and 31B. Here, first, the locked state of interior locking portion 10Ac and exterior locking portion 5Aa is released, and central turning components 4A and 4B and connecting turning component 5A turn by means of the elastic force of spring 30A. Next, lateral turning components 7A and 7B move backwardly by means of the elastic force of springs 31A and 31B, due to the turning of lateral turning components 7A and 7B being allowed by means of the turning of central turning components 4A and 4B.

Further, to restore the shape of toy 1A from the character shape (the second shape) to the spherical shape (the first shape), first, work against the elastic force of springs 31A and 31B and turn lateral turning components 7A and 7B of the exterior structure forwardly. Next, work against the elastic force of spring 30 and turn central turning components 4A and 4B and connecting turning component 5A backwardly, and lock exterior locking portion 5Aa of the exterior structure and interior locking portion 10Ac of the interior structure. By means of such an operation, the shape of the exterior of toy 1A is restored to a spherical shape. And, the spherical shape of toy 1A is maintained until a magnetic force acts once again.

In toy 1A pertaining to the embodiment described above, toy 1A can maintain a rollable, spherical shape (the first shape) until a force (magnetic force) that attracts magnet 9A acts from the exterior of toy 1A. Consequently, the realization of games such as shooting games in which toy 1A pertaining to the present embodiment is sent running through a travel motion toy, for example, is potentiated. Further, simply by effecting a magnetic force from the exterior of toy 1A, magnet 9A and interior turning component 8A within the interior of toy 1A turn, and the locked state of interior locking portion 10Ac of the interior structure and exterior locking component 5Aa of the exterior structure is thereby released, and toy 1A can hence automatically transform from the spherical shape to the character shape (the second shape). Consequently, by positioning a metallic etc. magnet in a particular location on a travel motion toy, for example, the sudden transformation of toy 1A traveling on the travel motion toy in a rollable, spherical shape to a different shape (the second shape), on this particular location, is potentiated. Further, because the mechanism for transforming toy 1A is relatively simple, the realization of the miniaturization of the toy is also potentiated. Hereby, the commercial value of the toy can be dramatically increased, and the impartation of fresh wonderment and intellectual excitement to its players is potentiated.

Further, in toy 1A pertaining to the embodiment described above, the exterior structure is constructed in such a way that it is restorable from the character shape (the second shape) to the spherical shape 9 the first shape), and moreover, in the event that the exterior structure has been restored to the spherical shape, a locked state of interior locking portion 10Ac and exterior locking portion 5Aa is realized, and this spherical shape is thereby maintained once again. Consequently, even after toy 1A has transformed from the spherical shape to the character shape by means of the action of a magnetic force, toy 1A can be restored to a rollable, spherical shape and re-used, and games such as shooting games can hence be carried out repeatedly.

Furthermore, the present invention is not limited to the above embodiments; a variety of transformations are possible without departing from the scope thereof. For example, in the above embodiments, although examples of the realization of the transformation of the toy by means of placing a magnet in the interior of the toy in such a way that it is movable (turnable) and placing a metallic or other magnetic substance at the exterior of the toy and causing the magnetic inside the toy to move (turn) have already been shown, the transformation of the toy may also be realized by means of placing a metallic or other magnetic substance in the interior of the toy in such a way that it is movable (turnable) and placing a magnet at the exterior of the toy, which attracts the magnetic substance inside the toy and causes it to move (turn).

Further, in the above embodiments, although examples of the realization of the transformation of the toy by means of attracting the magnetic substance (magnet) inside the toy and causing it to move from the central location to the near-surface location of the toy have already been shown, the aspect of the moving (turning) of the magnetic substance (magnet) inside the toy is not limited to this. For example, the employment of a structure that causes the magnetic substance inside the toy to move (turn) from the near-surface location to the central location of the toy, by means of causing the magnetic pole of the magnetic substance on the exterior and the magnetic pole of the magnetic substance inside the toy to repel each other and thereby realize the transformation of the toy, is also possible. To employ such a structure, interchange the magnet assigned to the interval between the central location of the toy and the near-surface location of the toy (for example, magnets 11 and 9A in the said embodiments) and the moving space of the magnet and location thereof, and at the very least furnish the interval between the center of the toy and the magnet with this space.

Further, in the above embodiments, although examples in which a "spherical shape" is employed as the first shape of the toy have already been shown, other rollable shapes (a rugby ball shape or a circular, tubular shape, for example) can also be employed as the first shape of the toy. Further, the second shape of the toy is also not particularly limited; a variety of shapes can be employed.

Further, in the above embodiments, although examples in which springs were employed as the biasing means, transformation means and turning means, rubber or other elastic bodies can also be employed as the biasing means, etc.

EXPLANATION OF LETTERS AND NUMBERS

1 & 1A Toy
3 Upper component (the second exterior turning component)
4-7 Lateral components (the first exterior turning components)
4A & 4B Central turning components (the first exterior turning components) 5A Connecting turning component (the first exterior turning component)
7A & 7B Lateral turning components (the second exterior turning components)
5*c*, 7*c* & 5Aa Exterior locking portions
8A Interior turning component (the first interior turning portion)
10A Turning locking component (the second interior turning portion)
10*c* & 10Ac Interior locking portion
11 & 9*a* Magnet (magnetic body)
12 & 11A Springs (biasing means)
20 Turning axis (the second exterior turning axis)
21 & 22 Turning axes (the first exterior turning axes)
30, 31 & 32 Springs (transformation means, turning means)

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method of playing a game, comprising the steps of:

providing an external releaser target for use during play of the game;

providing an expandable traveling toy for use during play of the game, the expandable traveling toy being physically separable from the external releaser target and being configured to be selectively placed into a compact-shape position and a character-shape position, the expandable traveling toy comprising:

a main body, a first auxiliary component pivotable relative to the main body, a second pivotable auxiliary component, and a magnetically-responsive releasable latch for selectively maintaining and releasing the expandable traveling toy from the compact-shape position to the character-shape position, a magnet attached to the magnetically-responsive releasable latch, a coil spring that biases the magnetically-responsive releasable latch to a position that maintains the expandable traveling toy in the compact-shape position, wherein the coil spring is disposed around the magnet and around a portion of the magnetically-responsive releasable latch such that the coil spring engages a peripheral surface of the portion of the magnetically-responsive releasable latch, wherein, when the expandable traveling toy is in the compact-shape position, the first auxiliary component and the second auxiliary component form a portion of an exterior structure of the expandable traveling toy, and the main body and the magnetically-responsive releasable latch are contained within an interior of the exterior structure;

instructing a user to place the external releaser target at a first location on a surface;

instructing the user to place the expandable traveling toy at a second location on the surface or another surface;

instructing the user to roll, while in the compact-shape position, the expandable traveling toy to induce a rolling of the exterior structure along and in contact with the surface or the another surface towards the external releaser target, such that the expandable traveling toy is at least proximate the external releaser target, wherein upon the expandable traveling toy being at least proximate the external releaser target, the magnet of the expandable traveling toy and the external releaser target are magnetically attracted to each other in response to a magnetically-attractive force, wherein, in response to the magnet and the external releaser target and the expandable traveling toy being magnetically attracted to each other in response to the magnetically-attractive force, the magnetically-responsive releasable latch is actuated, wherein, upon actuation of the magnetically-responsive releasable latch, the first auxiliary component and the second auxiliary component pivot to place the expandable traveling toy in the character-shape position, wherein when in the character-shape position, the rolling of the exterior structure along and in contact with the surface or the another surface is prevented due to a position of either or both of the first auxiliary component or the second auxiliary component relative to the main body, wherein each of the first and second auxiliary components remains mechanically connected, directly or indirectly, to the main body when the expandable traveling toy is in the character-shape position; and instructing the user to repeat play of the game by pivoting the first auxiliary component and the second auxiliary component to place the expandable traveling toy in the compact-shape position and secure the magnetically-responsive releasable latch.

2. The method of claim 1, wherein the instruction to roll the expandable traveling toy towards the external releaser target is an instruction to manually push the expandable traveling toy to induce rolling across the surface or the another surface.

3. The method of claim 2, wherein at least a portion of the second auxiliary component contacts at least a portion of the first auxiliary component.

4. The method of claim 2, wherein the second auxiliary component is pivotably connected to the first auxiliary component.

5. The method of claim 4, the expandable traveling toy further comprising a third auxiliary component pivotably connected to the first auxiliary component.

6. The method of claim 4, the expandable traveling toy further comprising a third auxiliary component pivotably connected to the second auxiliary component.

7. The method of claim 4, further comprising a fourth auxiliary component pivotably connected to the main body and extending outwardly from the main body independently of the first auxiliary component.

8. The method of claim 1, wherein of the external releaser target comprises another magnet.

9. The method of claim 8, wherein the magnetically-responsive releasable latch includes a spring imparting a spring force on both the first and second auxiliary components to place the expandable traveling toy in the character-shape position.

10. The method of claim 1, wherein said expandable traveling toy and said external releaser target are configured such that said magnetically-responsive releasable latch is actuated responsive to said magnetically-attractive force only upon one of said expandable traveling toy and said external releaser target being placed in a specific orientation relative to said other of the expandable traveling toy and the external releaser target.

11. A method of playing a game, comprising the steps of:

rolling, while in a compact-shape position, an expandable traveling toy across a surface and towards an external releaser target, wherein the expandable traveling toy comprises:

a main body, a first auxiliary component pivotable relative to the main body, a second pivotable auxiliary component, a third pivotable auxiliary component, and a magnetically-responsive releasable latch for selectively maintaining and releasing the expandable traveling toy from the compact-shape position to a character-shape position, a magnet attached to the magnetically-responsive releasable latch, a coil spring that biases the magnetically-responsive releasable latch to a position that maintains the expandable traveling toy in the compact-shape position, wherein the coil spring is disposed around the magnet and around a portion of the magnetically-responsive releasable latch such that the coil spring engages a peripheral surface of the portion of the magnetically-responsive releasable latch, wherein, when the expandable traveling toy is in the compact-shape position, the first through third auxiliary components form a portion of an exterior structure of the expandable traveling toy, and the main body and the magnetically-responsive releasable latch are contained within an interior of the exterior structure, wherein the rolling comprises the exterior structure rolling along and in contact with the surface;

in response to the rolling, moving the expandable traveling toy proximate to or in contact with the external releaser target to induce a magnetically-attractive force between the magnet and the external releaser target;

in response to inducing the magnetically-attractive force between the magnet and the external releaser target, actuating the magnetically-responsive releasable latch of the expandable traveling toy;

in response to actuating the magnetically-responsive releasable latch, pivoting the first auxiliary component away from the main body of the expandable traveling toy;

in response to actuating the magnetically-responsive releasable latch, pivoting the second auxiliary component;

in response to actuating the magnetically-responsive releasable latch, pivoting the third auxiliary component; and in response to pivoting the first, second, and third auxiliary components, positioning the expandable traveling toy to a character-shape position in which the rolling of the exterior structure along and in contact with the surface is prevented due to positions of the pivoted first, second, and third auxiliary components.

12. The method of claim 11, wherein the magnetically-responsive releasable latch directly secures at two of the first, second, and third auxiliary components to position the expandable traveling toy in the compact-shape position.

13. The method of claim 11, wherein when in the character-shape position, the expandable traveling toy is prevented from rolling along the surface due to a position of any one of the first, second, or third auxiliary components.

14. The method of claim 13, wherein each of the first, second, and third auxiliary components remains mechanically connected, directly or indirectly, to the main body when the expandable traveling toy is in the character-shape position.

15. The method of claim 14, wherein the second auxiliary component is pivotably connected to the first auxiliary component.

16. The method of claim 15, wherein the third auxiliary component is pivotably connected to the second auxiliary component.

17. The method of claim 14, wherein at least one of the external releaser target and the magnetically-responsive releasable latch comprises a magnet; and wherein the magnetically-responsive releasable latch includes a spring imparting a spring force on the first, second, and third auxiliary components to place the expandable traveling toy in the character-shape position.

18. A method of playing a game, comprising the steps of:

providing an external releaser target for use during play of the game;

providing an expandable traveling toy for use during play of the game, the expandable traveling toy being physically separable from the external releaser target and being configured to be selectively placed into a compact-shape position and a character-shape position, the expandable traveling toy comprising:

a main body, a first auxiliary component pivotably connected to the main body and pivotable about a first axis, a second auxiliary component pivotably connected to the first auxiliary component, a third auxiliary component pivotably connected to the main body and pivotable about a second axis, wherein the first axis and second axis are non-parallel, a fourth auxiliary component pivotably connected to the main body and pivotable about a third axis, a fifth pivotable auxiliary component, and a magnetically-responsive releasable latch for selectively maintaining and releasing the expandable traveling toy from the compact-shape position to the character-shape position, wherein the magnetically-responsive releasable latch includes a spring imparting a spring force on at least one of the first through fifth auxiliary components to place the expandable traveling toy in the character-shape position, a magnet attached to the magnetically-responsive releasable latch, a coil spring that biases the magnetically-responsive releasable latch to a position that maintains the expandable traveling toy in the compact-shape position, wherein the coil spring is disposed around the magnet and around a portion of the magnetically-responsive releasable latch such that the coil spring engages a peripheral surface of the portion of the magnetically-responsive releasable latch, wherein, when the expandable traveling toy is in the compact-shape position, the first through fifth auxiliary components form a portion of an exterior structure of the expandable traveling toy, and the main body and the magnetically-responsive releasable latch are contained within an interior of the exterior structure;

instructing a user to place the external releaser target at a first location on a surface;

instructing the user to place the expandable traveling toy at a second location on the surface or another surface;

instructing the user to roll, while in the compact-shape position, the expandable traveling toy to induce a rolling of the exterior structure along and in contact with the surface or the another surface towards the external releaser target, such that the expandable traveling toy is at least proximate the external releaser target, wherein upon the expandable traveling toy being at least proximate the external releaser target, the magnet of the expandable traveling toy and the external releaser target are magnetically attracted to each other in response to a magnetically-attractive force, wherein, in response to the magnet of the external releaser target and the expandable traveling toy being magnetically attracted to each other in response to the magnetically-attractive force, the magnetically-responsive releasable latch is actuated, wherein, upon actuation of the magnetically-responsive releasable latch, the first through fifth auxiliary components pivot to place the expandable traveling toy in the character-shape position, wherein when in the character-shape position, the rolling of the exterior structure along and in contact with the surface or the another surface is prevented due to a position of either or both of the first auxiliary component or the second auxiliary component relative to the main body, wherein each of the first through fifth auxiliary components remains mechanically connected, directly or indirectly, to the main body when the expandable traveling toy is in the character-shape position; and instructing the user to repeat play of the game by pivoting the first through fifth auxiliary components to place the expandable traveling toy in the compact-shape position and secure the magnetically-responsive releasable latch.

19. The method of claim 18, wherein the instruction to roll the expandable traveling toy towards the external releaser target is an instruction to manually push the expandable traveling toy to induce rolling across the surface or the another surface.

20. The method of claim 19, wherein the fifth pivotable auxiliary component is pivotably connected to the main body and pivotable about a fourth axis, and wherein the third and fourth axes are generally parallel.

* * * * *